US008395523B2

(12) United States Patent
Wolf et al.

(10) Patent No.: US 8,395,523 B2
(45) Date of Patent: Mar. 12, 2013

(54) METHOD AND SYSTEM FOR PREVENTING FUEL THEFT

(75) Inventors: James V. Wolf, Boca Raton, FL (US); John R. Garrity, Loxahatchee, FL (US)

(73) Assignee: John R. Garrity, Royal Palm Beach, FL (US)

( * ) Notice: Subject to any disclaimer, the term of this patent is extended or adjusted under 35 U.S.C. 154(b) by 807 days.

(21) Appl. No.: 12/579,070

(22) Filed: Oct. 14, 2009

(65) Prior Publication Data

US 2010/0090855 A1 Apr. 15, 2010

Related U.S. Application Data

(60) Provisional application No. 61/105,291, filed on Oct. 14, 2008.

(51) Int. Cl.
*G08B 21/00* (2006.01)

(52) U.S. Cl. ..... 340/686.6; 340/687; 235/441; 235/449; 235/492; 235/493; 235/381; 235/379; 235/380

(58) Field of Classification Search ..... 340/686.7, 340/687; 235/381, 379, 380, 441, 449, 492, 235/493

See application file for complete search history.

(56) References Cited

U.S. PATENT DOCUMENTS

| | | | | |
|---|---|---|---|---|
| 3,951,307 | A | 4/1976 | Muller et al. | |
| 5,110,010 | A | 5/1992 | Smith | |
| 5,363,988 | A | 11/1994 | Saxton et al. | |
| 6,109,477 | A | 8/2000 | Myers et al. | |
| 6,149,033 | A | 11/2000 | Poleshuk | |
| 6,354,464 | B1 | 3/2002 | Smith et al. | |
| 6,446,049 | B1 | 9/2002 | Janning et al. | |
| 6,466,842 | B1 | 10/2002 | Hartsell, Jr. | |
| 7,938,321 | B2 * | 5/2011 | Harrell | 235/381 |
| 8,181,495 | B2 | 5/2012 | Kiest et al. | |
| 2006/0190129 | A1 | 8/2006 | DeLine et al. | |
| 2007/0106559 | A1 * | 5/2007 | Harrell | 705/21 |
| 2007/0109068 | A1 | 5/2007 | Smith et al. | |
| 2007/0119859 | A1 * | 5/2007 | Harrell | 222/52 |
| 2007/0265733 | A1 * | 11/2007 | Harrell | 700/283 |
| 2008/0040287 | A1 * | 2/2008 | Harrell et al. | 705/71 |
| 2008/0128453 | A1 | 6/2008 | Burckholter et al. | |
| 2009/0058641 | A1 | 3/2009 | DeMarco | |
| 2010/0089485 | A1 * | 4/2010 | Wolf et al. | 141/1 |
| 2010/0090855 | A1 | 4/2010 | Wolf et al. | |

* cited by examiner

*Primary Examiner* — Daryl Pope

(74) *Attorney, Agent, or Firm* — Fox Rothschild LLP; Carol Thorstad-Forsyth

(57) ABSTRACT

A method and system for preventing fuel theft includes one or more tamper detection sensors mounted on a fuel dispenser, the tamper detection sensors being operable to detect dislocation of one or more portions of the fuel dispenser's shell. A dispenser security controller is communicatively coupled to the one or more tamper detection sensors and is operable to generate a trigger signal in response to receiving a tamper detection signal from the one or more tamper detection sensors. A dispenser transaction-termination switch is electrically coupled to the fuel dispensing circuit and in signal communication with the dispenser security controller and is operable to simulate a fuel pump handle hang up and/or a transaction not-authorized condition in response to a trigger signal from the dispenser security controller.

18 Claims, 5 Drawing Sheets

METHOD AND SYSTEM FOR PREVENTING FUEL THEFT

CROSS-REFERENCE TO RELATE APPLICATION

This application claims the priority, under 35 U.S.C. §119, ofU.S. Provisional Patent Application No. 61/105,291, filed Oct. 14, 2008; the prior application is herewith incorporated by reference herein in its entirety.

FIELD OF THE INVENTION

The present invention relates generally to fuel dispensers, and more particularly relates to a method and device for detecting tampering at a fuel dispenser and automatically disabling the pump to prevent theft of fuel.

BACKGROUND OF THE INVENTION

Theft of fuel is a major problem for operators of service stations that dispense gasoline. Would-be thieves resort to many different measures to remove or destroy the outer shell of the fuel pump in an effort to access various mechanisms of the pump that are normally inaccessible due to the shell. One target of thieves is one or more metering devices housed within the shell that convert a flow of fuel to an electronic signal indicating an amount of fuel being dispensed. The metering device allows the service station to charge the customer an amount of money that is proportionate to the amount of fuel dispensed. However, if this metering device can be disengaged (by destruction, separation, damaging, or other ways), no electronic signal is produced and fuel can be dispensed by the thief without a dollar value being assigned to the fuel removed from the pump. Of course, with fuel currently varying from about $2.50 per gallon to about $5.00 per gallon, loss of fuel to theft is highly undesirable to the service station operators.

Prior-art fuel theft detection systems disable fuel dispensers once tampering is detected by cutting off power to the entire dispenser. This method of disablement is disadvantageous because disabling power to the entire dispenser also shuts down the sensitive computer equipment, which contains previous transaction information, calibration information, and others. In addition, dispenser communication to the nearby in-station cashier is disabled. The dispenser simply goes dead.

Some prior-art dispenser security systems simply cut power to the control valve located within a dispenser while leaving the rest of the dispenser under power. This method is disadvantageous because shutting off the valve does not shut off the submerged turbine pump (STP), does not stop the pumping unit, does not finalize the sale, does not notify the pump controller of the shut down, which in turn changes an indicator for the cashier or attendant at the control system, and could result dangerous voltage transients at the time of switching.

Therefore, a need exists to overcome the problems with the prior art as discussed above.

SUMMARY OF THE INVENTION

The invention provides a method and device for preventing fuel theft that overcomes the hereinafore-mentioned disadvantages of the heretofore-known devices and methods of this general type and that disable a fuel pump as if the pump handle had simply been returned to its cradle on the pump (referred to as a "hang up") and/or a transaction authorization had been declined by a financial institution.

Briefly, in accordance with the present invention, disclosed is a method and system for preventing fuel theft includes one or more tamper detection sensors mounted on a fuel dispenser, the tamper detection sensors being operable to detect dislocation of one or more portions of the fuel dispenser's shell. A dispenser security controller is communicatively coupled to the one or more tamper detection sensors and is operable to generate a trigger signal in response to receiving a tamper detection signal from one or more of the tamper detection sensors. A dispenser transaction-termination switch is electrically coupled to the fuel dispensing circuit and in signal communication with the dispenser security controller and is operable to simulate a fuel pump handle hang up and/or a transaction not-authorized condition in response to a trigger signal from the dispenser security controller.

In accordance with a further feature of the present invention, the simulation electrically mimics a movement of a hang up lever at a location on the shell.

In accordance with yet another feature of the present invention, the simulation opens the fuel dispensing circuit at a hang up lever location on the shell.

In accordance with an additional feature of the present invention, the simulation of a transaction-not-authorized condition mimics a receipt of an authorization decline signal received at the fuel dispenser from a banking institution.

In accordance with another feature, the simulation does not interrupt power to the payment terminal attached to the fuel dispenser.

In accordance with another feature, the simulation is operable to at least temporarily prevent subsequent fuel purchase transactions.

In accordance with another feature, an embodiment of the present invention includes at least one of the one or more tamper detection sensors comprising a magnetic reed switch that is held in a first position when a magnet is in proximity to the magnetic reed switch and moves to a second position when the magnet is not within proximity to the magnetic reed switch.

In accordance with a further feature, the present invention includes the dispenser transaction-termination switch in series with a portion of the fuel dispensing circuit.

In accordance with another feature, an embodiment of the present invention also includes a method for preventing theft of fuel from a fuel dispenser that includes a fuel dispenser shell and a fuel dispensing circuit that controls the dispensing of fuel from the fuel dispenser. The method includes the steps of monitoring one or more tamper detection sensors mounted on the dispenser, the tamper detection sensors being operable to detect an intrusion into a fuel dispenser shell, generating a trigger signal with a dispenser security controller communicatively coupled to the one or more tamper detection sensors in response to receiving a tamper detection signal from the one or more tamper detection sensors, and simulating with a dispenser transaction-termination switch electrically coupled to the fuel dispensing circuit and in signal communication with the dispenser security controller a fuel pump handle hang up and/or a transaction not-authorized condition in response to a trigger signal from the dispenser security controller.

Although the invention is illustrated and described herein as embodied in a method and device for preventing fuel theft, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an", as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

BRIEF DESCRIPTION OF THE DRAWINGS

The accompanying figures, where like reference numerals refer to identical or functionally similar elements throughout the separate views and which, together with the detailed description below, are incorporated in and form part of the specification, serve to further illustrate various embodiments and to explain various principles and advantages all in accordance with the present invention.

DETAILED DESCRIPTION

Figure 1:
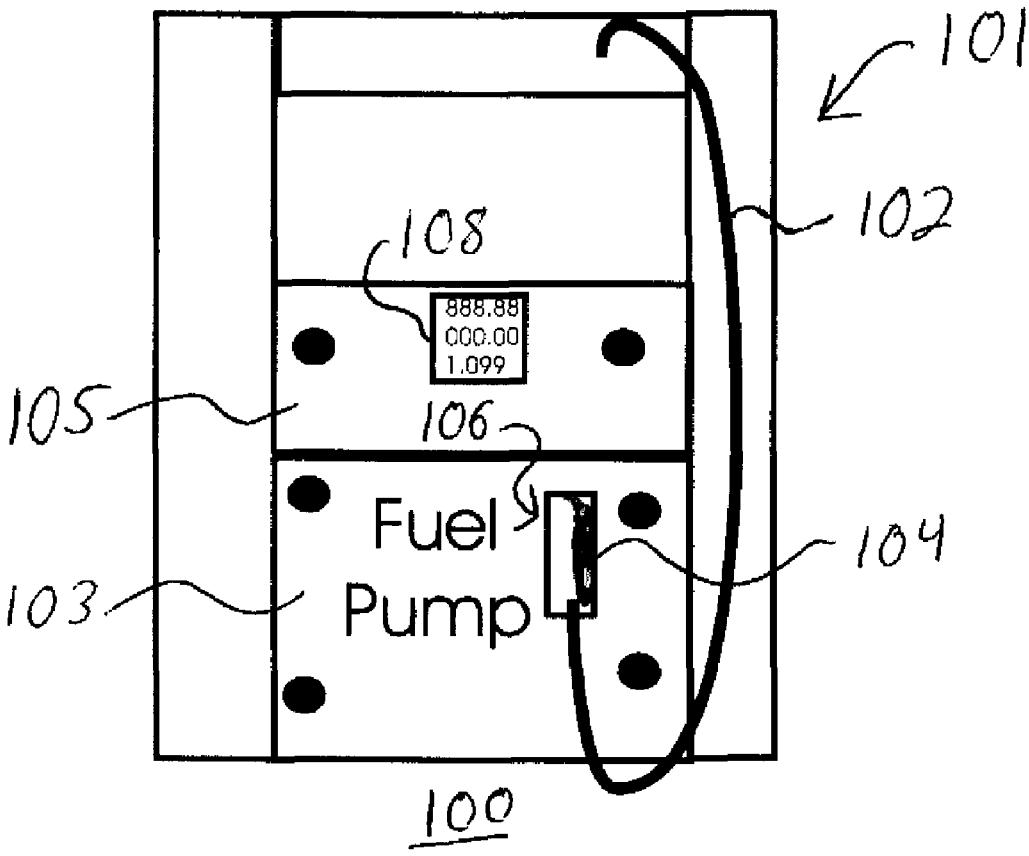
FIG. 1 is a front elevational view of a prior art fuel dispenser to be used with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient anti-tampering device at a fuel dispenser. The anti-tampering device detects the removal of a protective dispenser cover and immediately places the dispenser in a pump-handle hang-up state. Placing the dispenser in a pump-handle hang-up state, as opposed to disabling the entire dispenser or valve, provides many advantages over the prior art dispenser disablement methods.

Referring now to FIG. 1, an exemplary embodiment of the present invention is described. FIG. 1 illustrates several advantageous features of the present invention, but, as will be described below, the invention can be provided in several shapes, sizes, combinations of features and components, and varying numbers and functions of the components. In this first embodiment of FIG. 1, the inventive anti-tampering device is installed on a traditional fuel dispenser 100 that is used to pump fuel out of a storage tank (not shown) through a hose 102 and out of a handle/nozzle 104. The fuel dispenser 100 shown in FIG. 1 includes a protective shell 101 that conceals and protects various components housed within the shell 101. The shell 101 typically includes multiple sections that are each individually removable and allow access to the various components housed therein. For instance, the shell 101 shown in FIG. 1 has a first portion 103 that covers a lower region of the fuel dispenser 100 and a second portion 105 that covers a middle region of the fuel dispenser 100. The instant invention protects the components housed within the shell from unauthorized access. For many fuel dispensers, removal or any dislocation, i.e., moving, separating, damaging, etc., of the shell regions provides access to fuel flow meters, the removal of which can allow one to dispense fuel without charge.

A payment terminal 108 is present on the shell or accessible through the shell and allows a customer to activate the fuel dispenser 100 by providing payment credentials, such as a credit card, a debit card, a gift card, and others, to the payment terminal 108 and having the payment terminal 108 verify the credentials, by communicating with a remote banking institution, before placing the fuel dispenser 100 in an activated state. Alternatively, an attendant inside the service station can remotely activate the fuel dispenser 100, usually after receiving payment at a main payment terminal, which is central to all available fuel dispensers at a particular service station. However, fuel cannot be dispensed unless the payment terminal 108 permits dispensing or the dispenser is manually configured to allow pumping, both of which are embodied here as activation of an activation switch 226 (shown in FIG. 2).

Still referring to FIG. 1, the fuel dispenser 100 includes a handle/nozzle hang-up port 106 in the shell 101. The hang-up port 106 includes a switch 224 (shown in FIG. 2) that prevents the fuel dispenser 100 from operating as long as the handle/nozzle 104 is present within the hang-up port 106. Operatively, the hang-up port 106 renders a trigger on the handle/nozzle 104 inoperable when the switch 224 is in its normal steady-state, i.e., when the handle/nozzle 104 is inserted into the hang-up port 106. By deactivating the functionality of the handle/nozzle 104, the hang-up port 106 prevents fuel from dispensing through the handle/nozzle 104 when a user squeezes the trigger on the handle/nozzle 104.

It should be clear from the description herein that for fuel to be dispensed from the fuel dispenser 100, two events need to occur: (1) the handle/nozzle 104 must be removed from the hang-up port 106 so that the hang-up switch 224 is activated; and (2) the pump must be activated either manually or by receiving a payment authorization signal, either from a financial institution to which the fuel dispenser 100 is communicatively coupled or from the service attendant, both activations activating authorization switch 226. In the event of manual authorization, advance payment is not required and the fuel dispenser 100 is configured in advance to always have a positive payment authorization signal, i.e., the authorization switch 226 is activated. It should be noted that, depending on the circuit designer's selection, some switches are normally-open switches and other switches are normally-closed. Instead of using the specific terms "open" and "close" with reference to switches, the term "activate" or "activated," is used herein and is intended to indicate movement of a switch from one state to another state, whether open to closed or vice versa.

In addition, all known commercial fuel dispensers are configured so that replacement of the handle/nozzle 104 finalizes the fuel purchase transaction. More specifically, after pumping fuel or even while actively pumping fuel, once the switch inside the hang-up port 106 registers a handle/nozzle hang up, the transaction is closed. If further fuel pumping is desired by the customer, an entirely new transaction must be initiated. It is the functionality of this hang-up port 106 that is specifically and advantageously affected by an embodiment of the present invention.

Figure 2:
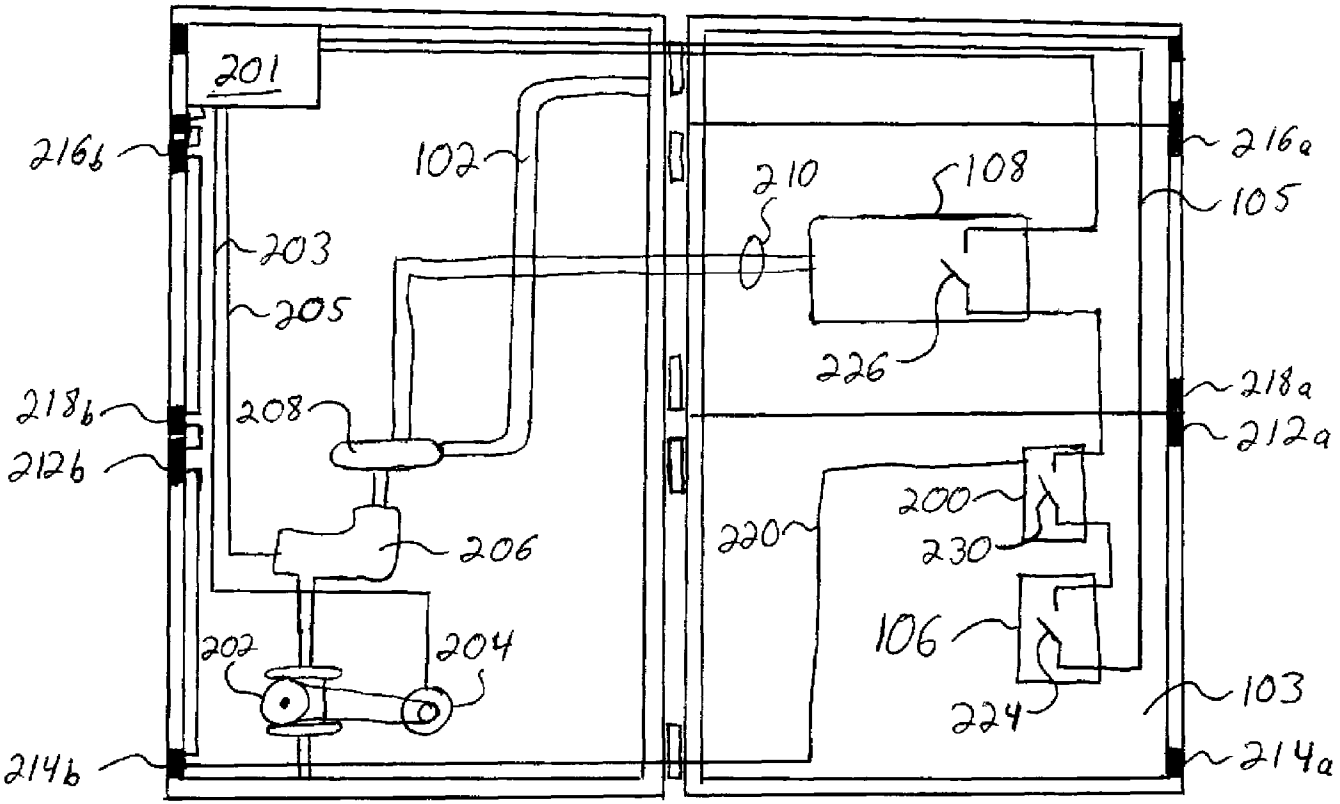
FIG. 2 is a front elevational view of the fuel dispenser of FIG. 1 with the shell opened and with the internal components exposed.

The mechanical/electrical effect on the fuel dispenser 100 of a hang up will now be described in conjunction with FIG. 2, which shows portions of the shell 101 of the fuel dispenser 100 of FIG. 1 removed, thereby exposing the interior of the fuel dispenser 100. A pump 202 is driven by a motor 204. The motor 204, in the particular embodiment shown, is located within the fuel dispenser 100 but, in other embodiments, can be located inside an enclosed fuel storage tank.

The motor 204 is controlled by control box 201, for example, through at least one control line 203. When power is applied to the motor 204, the pump 202 is driven and draws fuel from an underground fuel storage tank (not shown). The fuel then flows from the pump 202 to one or more control valves 206. The one or more control valves 206 are powered by control box 201, for example, through at least one control line 205, and control the rate of fuel flow to the hose 102. A metering device 208 electromechanically monitors a volume of fuel that is flowing from the valve to the hose 102 and communicates, through at least one communication line 210, to the payment terminal 108 so that an appropriate charge can be applied to the amount of fuel being pumped.

The hang-up port 106 includes a hang-up switch 224 and is communicatively connected to the control box 201. When the pump handle/nozzle 104 is hung up, the pump handle hang-up switch 224 sends a signal to the control box 201. Control logic, i.e., software, hardware, or a combination thereof, at the control box 201 shuts off power to the valve(s) 206 and the pump motor 204 (or STP relay). The sale is finalized within the control logic at control box 201 and the control box 201 sends data to the payment terminal 108 indicating an end of a sale.

The hang-up port 106 is also communicatively coupled to the payment terminal 108. Until the payment terminal 108 authorizes a transaction, the hang-up switch 224 is ineffective. In other words, no matter what the state of the hang-up switch 224, until the payment terminal 108 activates authorization switch 226, no fuel can flow. Again, the authorization switch 226 can also be activated manually by a service station attendant, for example.

A plurality of tamper detection sensors 212*a*, 212*b*, 214*a*, 214*b*, 216*a*, 216*b*, 218*a*, 218*b* are communicatively coupled to a dispenser security controller 200 in accordance with embodiments of the invention. The dispenser security controller 200 can be part of the control box 201, can be independent of the control box 201, or can operate in conjunction with the control box 201. In the exemplary embodiment shown, the tamper detection sensors 212*a*, 212*b*, 214*a*, 214*b*, 216*a*, 216*b*, 218*a*, 218*b* are provided in pairs, with 212*a* and 212*b* forming a first pair, 214*a* and 214*b* forming a second pair, 216*a* and 216*b* forming a third pair, and 218*a* and 218*b* forming a fourth pair. It should be noted that only a single tamper detection sensor is needed and the present invention can be provided with either more or less sensors or sensor pairs than are shown in FIG. 2.

When the shell portions 103 and 105 are closed, the tamper detection sensor pairs 212*a* and 212*b*, 214*a* and 214*b*, 216*a* and 216*b*, 218*a* and 218*b* are aligned and become mechanically or electrically, e.g., magnetically, coupled to each other. In one embodiment, the switches are magnetic reed switches. Many other types of switches or devices that can detect intrusions can also be used without departing from the spirit and scope of the present invention. Specifically, detection of a separation of two objects is not required and any attempted intrusion can be identified by a tamper detection sensor, which may be embodied in a variety of different devices/switches.

Tampering with the shell portions 103 and/or 105 causes any one of the sensor pairs to separate from each other. In one embodiment, as shown in FIG. 2, the tamper detection sensors 212*a*, 212*b*, 214*a*, 214*b*, 216*a*, 216*b*, 218*a*, and 218*b* are all electrically coupled to each other in a series configuration. In a series configuration, separation of any one of the tamper detection sensor pairs 212*a* and 212*b*, 214*a* and 214*b*, 216*a* and 216*b*, 218*a* and 218*b*, depending on the selected configuration, either opens or closes the sensor circuit, which is electrically coupled (for example, through communication line 220) to the dispenser security controller 200. Upon sensing a separation of the any one of the tamper detection sensor pairs 212*a* and 212*b*, 214*a* and 214*b*, 216*a* and 216*b*, 218*a* and 218*b*, the security controller 200 responds by activating a dispenser disablement switch 230. Alternatively, hang-up switch 224, itself, can be activated by the dispenser security controller 200.

Activation of the dispenser disablement switch 230 simulates a fuel pump handle hang up, causing the fuel dispenser 100 to operate as if a user had simply placed the handle/nozzle 104 back into the hang-up port 106. In other words, the handle/nozzle 104 is immediately deactivated so that no further fuel flow can take place. At this point, a would-be thief is unable to receive any fuel from the fuel dispenser 100. Advantageously, the fuel dispenser 100 is disabled in accordance with its manufacturer's designed deactivation method, i.e., simply by forcing a change of state of its normal dispenser control switch circuit. The change of state can be moving from normally open to normally closed, or vice versa, depending on the particular circuit design. Unlike prior art disablement techniques, that react to intrusion detection by cutting power to the entire dispenser, thereby destructively interfering with computing and pumping processes, or react by disabling specific pump components, thereby potentially causing pumping pressure dangers, sparks from high-voltage switching, transaction sale errors, and other disadvantageous affects, the present invention simply causes the device to function as it is intended and the fuel dispenser 100 suffers from no negative effects. The fuel dispenser 100 remains in this state until an attendant carries out a fuel dispenser reset. An alarm can also be activated, if desired, signaling a tampering detection.

Figure 3:
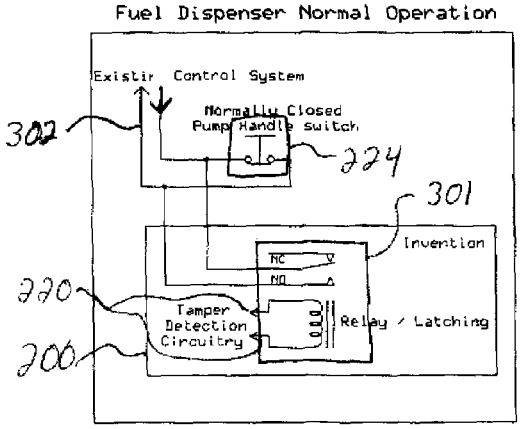
FIG. 3 is a schematic circuit diagram of an exemplary normal operation of a fuel dispenser tamper circuit that includes a pump handle switch having a normally closed state and a dispenser disablement switch in an electrically open state in accordance with the present invention.
Figure 5:
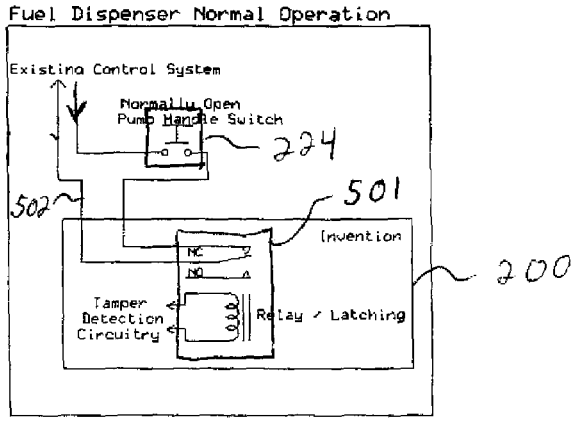
FIG. 5 is a schematic circuit diagram of an exemplary normal operation of a fuel dispenser tamper circuit that includes a pump handle switch having a normally open state and a dispenser disablement switch in an electrically short state in accordance with the present invention.
Figure 4:
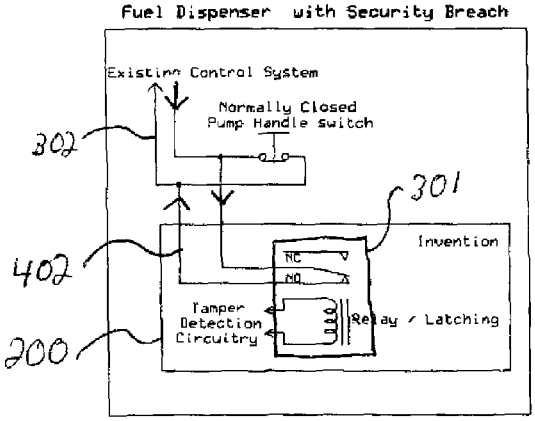
FIG. 4 is a schematic circuit diagram of the fuel dispenser tamper circuit of FIG. 3 in a security breach state where the dispenser disablement switch is in an electrically closed state in accordance with the present invention.
Figure 6:
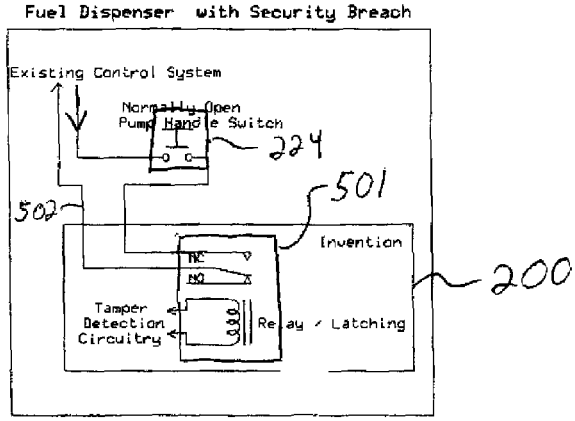
FIG. 6 is a schematic circuit diagram of the fuel dispenser tamper circuit of FIG. 5 in a security breach state where the dispenser disablement switch is in an electrically open state in accordance with the present invention.

FIGS. 3-10 show several exemplary schematics illustrating circuit configurations for carrying out the present invention. FIGS. 3 and 4 show the dispenser security controller 200 including a normally-open latching relay 301 coupled to the sensor line 220. FIGS. 5 and 6 show the dispenser security controller 200 including a normally-closed latching relay 501 coupled to the sensor line 220. FIGS. 7-10 show alternative switching devices.

Beginning with FIG. 3, an exemplary normal operation of a fuel dispenser tamper circuit is shown. In this configuration, the pump handle switch 224 is in a normally closed state providing a current path 302 through the switch 224. As long as current can flow through the current path 302, a controller within the fuel dispenser 100 ensures that no fuel can pump through the handle/nozzle 104. The dispenser disablement switch 230, in this embodiment, is a relay 301 that is coupled in parallel with the current path 302 and is in a normally open state, i.e., no current flows through the relay 301 and the normal function of the fuel dispenser 100 is unaffected. When the switch 224 is opened, current stops flowing through the current path 302 and the fuel dispenser 100 switches to a dispensing mode where fuel can be dispensed through handle/nozzle 104.

However, in accordance with the present invention, as shown in FIG. 4, upon detecting a fuel dispenser 100 tampering occurrence, the dispenser security controller 200 causes the relay 301 to move to the illustrated closed configuration. In this mode, a current path 402 is formed through the relay 301. The controller 200, 201 within the fuel dispenser 100 detects the short condition (the circuit is no longer open) and immediately responds by ceasing pumping conditions, exactly the same as if the hang-up switch 224 were closed. The relay 301 holds this current path state until the dispenser security controller 200 is reset. As long as the closed condition persists at the relay 301, i.e., current path 402 exists, the hang-up switch 224 cannot prevent current from flowing and, therefore, no fuel can be dispensed from the handle/nozzle 104 regardless of the state of the hang-up switch 224.

FIGS. 5 and 6 show an alternative circuit configuration where the dispenser disablement switch 230 is a normally-closed relay 501 and the hang-up switch 224 is a normally-open switch. In FIG. 5, the hang-up switch 224 is open and current is unable to flow through the switch 224 or the current path 502. With a normally open hang-up switch 224, the fuel dispenser 100 is configured to deactivate the handle/nozzle 104 when no current flows along current path 502 and across the hang-up switch 224. Because the relay 501 is normally closed and is in a series configuration with the hang-up switch 224, once the hang-up switch 224 is closed, current flows through both the switch 224 and the relay 501.

However, in accordance with the present invention, as shown in FIG. 6, upon detecting a fuel dispenser 100 tampering occurrence, the dispenser security controller 200 causes the relay 501 to move to the illustrated open configuration. In this mode, the current path 502 is broken. The fuel dispenser 100 detects the open condition and immediately responds by ceasing pumping conditions, exactly the same as if the hang-up switch 224 were opened. The relay 501 will hold this open condition until the dispenser security controller 200 is reset. As long as the relay open condition persists, the hang-up switch 224 cannot cause current to flow and, therefore, no fuel can be dispensed from the handle/nozzle 104 regardless of the state of the hang-up switch 224.

Figure 7:
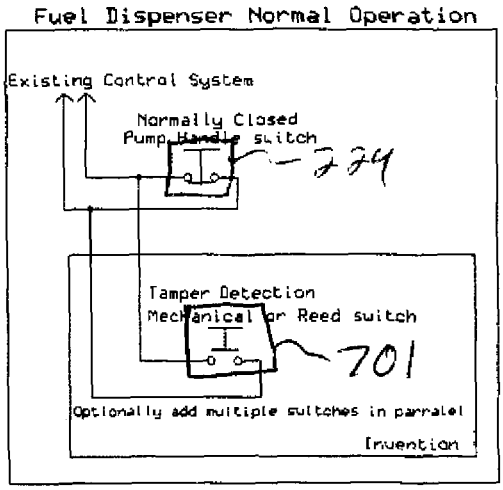
FIG. 7 is a schematic circuit diagram of an exemplary normal operation of a fuel dispenser tamper circuit that includes a pump handle switch having a normally closed state and a dispenser disablement switch in an electrically open state in accordance with the present invention.
Figure 9:
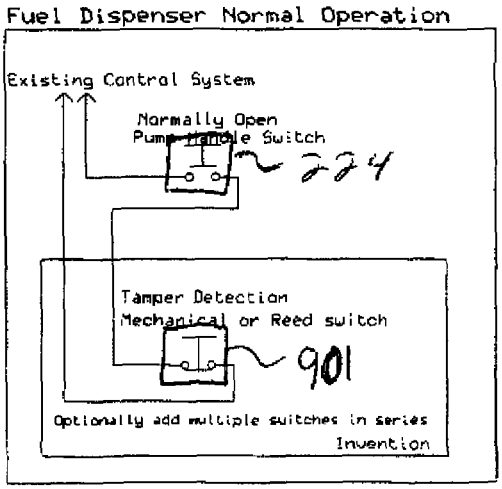
FIG. 9 is a schematic circuit diagram of an exemplary normal operation of a fuel dispenser tamper circuit that includes a pump handle switch having a normally open state and a dispenser disablement switch in an electrically short state in accordance with the present invention.
Figure 8:
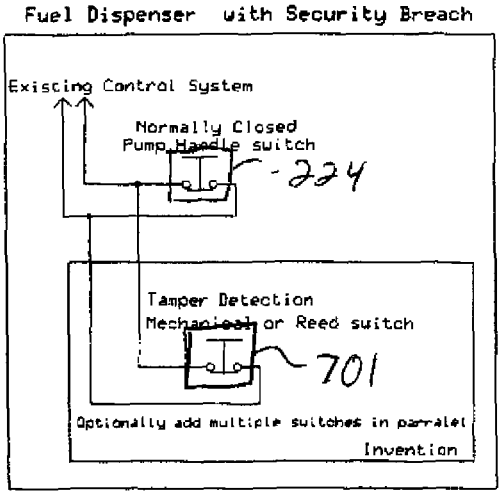
FIG. 8 is a schematic circuit diagram of the fuel dispenser tamper circuit of FIG. 7 in a security breach state where the dispenser disablement switch is in an electrically closed state in accordance with the present invention.
Figure 10:
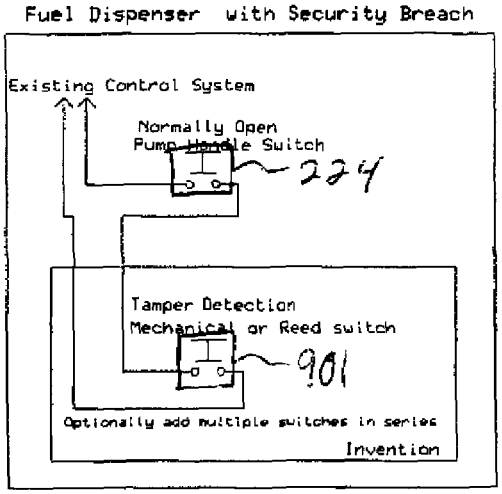
FIG. 10 is a schematic circuit diagram of the fuel dispenser tamper circuit of FIG. 9 in a security breach state where the dispenser disablement switch is in an electrically open state in accordance with the present invention.

FIGS. 7-10 correspond to FIGS. 3-6, respectively. In FIGS. 7 and 8, the normally-open relay 301 has been replaced with a simple normally-open switch 701, which can be, for instance, a mechanical switch, a reed switch, or any other switching mechanism capable of detecting separation of two objects. In FIGS. 9 and 10, the normally-closed relay 501 has been replaced with a simple normally-closed switch 901, which can be, for instance, a mechanical switch, a reed switch, or any other switching mechanism capable of detecting separation of two objects.

Figure 11:
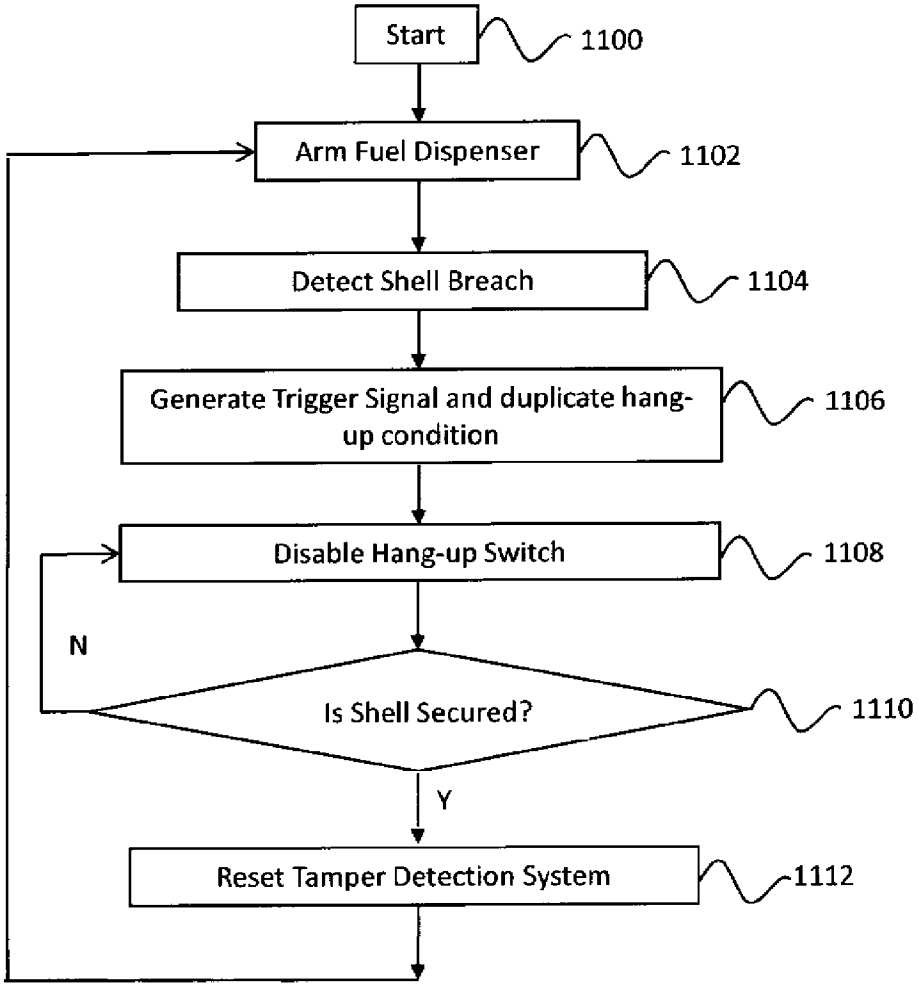
FIG. 11 is a process flow diagram showing an exemplary method of detecting a breach of a fuel dispenser and preventing unauthorized access to fuel according to the present invention.

FIG. 11 shows an exemplary process flow diagram illustrating an exemplary method of detecting fuel dispenser tampering and prevention of fuel flow. The process starts at step 1100 and moves directly to step 1102 where a fuel dispenser equipped with a tamper detection system in accordance with the present invention is armed and functional. In step 1104, a shell opening is detected.

In step 1106, the dispenser security controller 200 generates a trigger signal and duplicates a hang-up condition in response to receiving a tamper detection signal from the one or more tamper detection sensors 212*a*, 212*b*, 214*a*, 214*b*, 216*a*, 216*b*, 218*a*, and 218*b*. In step 1108, the trigger signal is received at a dispenser transaction-termination switch, e.g., 301, 501, 701, 901 that disables the dispensing function of the fuel dispenser 100 and renders the hang-up switch 224 inactive. In step 1110, the shell is reclosed, reset, or repaired. In step 1112, the tamper detection system is reset and the flow moves back up to step 1102 where the hang-up switch 224 once again becomes active.

A fuel dispenser tamper detection and response system has been disclosed that determines an unauthorized breach of a fuel dispenser's protective shell and responds by disabling the fuel dispenser's pump handle switch.

What is claimed is:

1. A fuel dispenser security system for use with a fuel dispenser having a shell and a fuel dispensing circuit that controls the dispensing of fuel from the fuel dispenser and includes a handle hang-up switch operable for placing the fuel dispenser in a fuel pump handle hang up condition that prevents dispensing of fuel and a payment authorization switch operable for placing the fuel dispenser in a transaction not-authorized condition that prevents dispensing of fuel, the fuel dispenser security system comprising:

at least one tamper detection sensor mountable at the fuel dispenser, the at least one tamper detection sensor being operable to detect dislocation of at least one portion of the fuel dispenser shell and output a tamper detection signal upon detecting such dislocation;

a dispenser security controller communicatively coupled to the at least one tamper detection sensor, the dispenser security controller being operable to generate a tamper trigger signal in response to receiving the tamper detection signal from the at least one tamper detection sensor; and a dispenser transaction-termination switch electrically coupled to the fuel dispensing circuit and in signal communication with the dispenser security controller, the dispenser transaction-termination switch operable to simulate at least one of:

the fuel pump handle hang up condition; and the transaction not-authorized condition, upon receipt of the tamper trigger signal from the dispenser security controller;

wherein the simulation is operable to at least temporarily prevent subsequent fuel purchase transactions.

2. The fuel dispenser security system according to claim 1, wherein the handle hang-up switch is moveable and the simulation of the fuel pump handle hang up condition electrically mimics a movement of the handle hang-up switch at a location on the shell.

3. The fuel dispenser security system according to claim 1, wherein the simulation opens the fuel dispensing circuit at a handle hang-up switch location on the shell.

4. The fuel dispenser security system according to claim 1, wherein:

the fuel dispenser has a payment terminal; and operation of the simulation does not interrupt power to the payment terminal.

5. The fuel dispenser security system according to claim 1, wherein the dispenser transaction-termination switch is in series with a portion of the fuel dispensing circuit.

6. The fuel dispenser security system according to claim 1, wherein the dispenser transaction-termination switch comprises:

a first position allowing normal operation of the fuel dispensing circuit; and a second position interrupting the fuel dispensing circuit.

7. A fuel dispenser security system for use with a fuel dispenser having a shell and a fuel dispensing circuit that controls the dispensing of fuel from the fuel dispenser and includes a handle hang-up switch operable for placing the fuel dispenser in a fuel pump handle hang up condition that prevents dispensing of fuel and a payment authorization switch operable for placing the fuel dispenser in a transaction not-authorized condition that prevents dispensing of fuel, the fuel dispenser security system comprising:

at least one tamper detection sensor mountable at the fuel dispenser, the at least one tamper detection sensor being operable to detect dislocation of at least one portion of the fuel dispenser shell and output a tamper detection signal upon detecting such dislocation;

a dispenser security controller communicatively coupled to the at least one tamper detection sensor, the dispenser security controller being operable to generate a tamper trigger signal in response to receiving the tamper detection signal from the at least one tamper detection sensor; and a dispenser transaction-termination switch electrically coupled to the fuel dispensing circuit and in signal communication with the dispenser security controller, the dispenser transaction-termination switch operable to simulate at least one of:

the fuel pump handle hang up condition; and the transaction not-authorized condition, upon receipt of the tamper trigger signal from the dispenser security controller;

wherein the simulation of the transaction not-authorized condition is an electrical mimic of an authorization decline signal received at the fuel dispenser from a banking institution.

8. A fuel dispenser security system for use with a fuel dispenser having a shell and a fuel dispensing circuit that controls the dispensing of fuel from the fuel dispenser and includes a handle hang-up switch operable for placing the fuel dispenser in a fuel pump handle hang up condition that prevents dispensing of fuel and a payment authorization switch operable for placing the fuel dispenser in a transaction not-authorized condition that prevents dispensing of fuel, the fuel dispenser security system comprising:

at least one tamper detection sensor mountable at the fuel dispenser, the at least one tamper detection sensor being operable to detect dislocation of at least one portion of the fuel dispenser shell and output a tamper detection signal upon detecting such dislocation;

a dispenser security controller communicatively coupled to the at least one tamper detection sensor, the dispenser security controller being operable to generate a tamper trigger signal in response to receiving the tamper detection signal from the at least one tamper detection sensor; and a dispenser transaction-termination switch electrically coupled to the fuel dispensing circuit and in signal communication with the dispenser security controller, the dispenser transaction-termination switch operable to simulate at least one of:

the fuel pump handle hang up condition; and the transaction not-authorized condition, upon receipt of the tamper trigger signal from the dispenser security controller;

wherein the at least one tamper detection sensor comprises:

a magnetic reed switch held in a first position when a magnet is in proximity to the magnetic reed switch and moves to a second position when the magnet is not within proximity to the magnetic reed switch.

9. In combination with a fuel supply system having a shell, a fuel dispenser with a fuel pump handle hang up condition that prevents dispensing of fuel when activated, and a fuel dispensing circuit that controls the dispensing of fuel from the fuel dispenser and has a transaction not-authorized condition that prevents dispensing of fuel when activated, a fuel dispenser security system, the improvement comprising:

at least one tamper detection sensor being operable to detect dislocation of at least one portion of the shell and to generate a tamper detection signal;

a dispenser security controller communicatively coupled to the at least one tamper detection sensor and being operable to generate a tamper trigger signal in response to receiving the tamper detection signal; and a dispenser transaction-termination switch electrically coupled to at least one of the fuel dispenser and the fuel dispensing circuit and in signal communication with the dispenser security controller, the dispenser transaction-termination switch operable to activate at least one of:

the fuel pump handle hang up condition; and the transaction not-authorized condition, in response to receipt of the tamper trigger signal from the dispenser security controller;

wherein the activation is operable to at least temporarily prevent subsequent fuel purchase transactions.

10. A method for preventing theft of fuel from a fuel dispenser that includes a fuel dispenser shell and a fuel dispensing circuit that controls the dispensing of fuel from the fuel dispenser, the method comprising:

monitoring at least one tamper detection sensor at the fuel dispenser shell, the at least one tamper detection sensor being operable to detect an intrusion into the fuel dispenser shell;

generating a trigger signal with a dispenser security controller communicatively coupled to the at least one tamper detection sensor in response to receiving a tamper detection signal from the at least one tamper detection sensor;

simulating with a dispenser transaction-termination switch electrically coupled to the fuel dispensing circuit and in signal communication with the dispenser security controller, at least one of:

a fuel pump handle hang up condition; and a transaction not-authorized condition, in response to receiving the trigger signal from the dispenser security controller; and carrying out the simulation to at least temporarily prevent subsequent fuel purchase transactions.

11. The method according to claim 10, which further comprises carrying out the fuel pump handle hang up condition by electrically mimicking a movement of a hang up lever at the fuel dispenser shell.

12. The method according to claim 10, which further comprises carrying out the fuel pump handle hang up condition by opening the fuel dispensing circuit at a hang up lever on the fuel dispenser shell.

13. The method according to claim 10, which further comprises carrying out the simulation while not interrupting power to a payment terminal at the fuel dispenser.

14. The method according to claim 10, wherein the dispenser transaction-termination switch is in series with a portion of the fuel dispensing circuit.

15. The method according to claim 10, wherein the dispenser transaction-termination switch comprises:

a first position allowing normal operation of the fuel dispensing circuit; and a second position interrupting a current path of the fuel dispensing circuit.

16. The method according to claim 10, further comprising carrying out a fuel pump hang up condition to terminate a sale in progress or prevent a fueling transaction from beginning.

17. A method for preventing theft of fuel from a fuel dispenser that includes a fuel dispenser shell and a fuel dispensing circuit that controls the dispensing of fuel from the fuel dispenser, the method comprising:

monitoring at least one tamper detection sensor at the fuel dispenser shell, the at least one tamper detection sensor being operable to detect an intrusion into the fuel dispenser shell;

generating a trigger signal with a dispenser security controller communicatively coupled to the at least one tamper detection sensor in response to receiving a tamper detection signal from the at least one tamper detection sensor; and simulating with a dispenser transaction-termination switch electrically coupled to the fuel dispensing circuit and in signal communication with the dispenser security controller, at least one of:

a fuel pump handle hang up condition; and a transaction not-authorized condition, in response to receiving the trigger signal from the dispenser security controller;

carrying out the simulation of a transaction not-authorized condition by mimicking a receipt of an authorization decline signal received at the fuel dispenser from a banking institution.

18. A method for preventing theft of fuel from a fuel dispenser that includes a fuel dispenser shell and a fuel dispensing circuit that controls the dispensing of fuel from the fuel dispenser, the method comprising:

monitoring at least one tamper detection sensor at the fuel dispenser shell, the at least one tamper detection sensor being operable to detect an intrusion into the fuel dispenser shell;

generating a trigger signal with a dispenser security controller communicatively coupled to the at least one tamper detection sensor in response to receiving a tamper detection signal from the at least one tamper detection sensor; and simulating with a dispenser transaction-termination switch electrically coupled to the fuel dispensing circuit and in signal communication with the dispenser security controller, at least one of:

a fuel pump handle hang up condition; and a transaction not-authorized condition, in response to receiving the trigger signal from the dispenser security controller;

wherein the at least one tamper detection sensor comprises:

a magnetic reed switch that is held in a first position when a magnet is in proximity to the magnetic reed switch and moves to a second position when the magnet is not within proximity to the magnetic reed switch.

* * * * *